United States Patent [19]

McKeen, Sr.

[11] 3,990,681

[45] Nov. 9, 1976

[54] PNEUMATIC RAMP FOR VEHICLE LEVELING

[76] Inventor: Edwin E. McKeen, Sr., P.O. Box 1589, Omak, Wash. 98841

[22] Filed: Jan. 29, 1976

[21] Appl. No.: 653,486

[52] U.S. Cl. ..... 254/88; 254/93 MP
[51] Int. Cl.[2] ..... B66F 3/24
[58] Field of Search ..... 254/93 MP, 88

[56] References Cited

UNITED STATES PATENTS

| | | | |
|---|---|---|---|
| 1,493,729 | 5/1924 | Brown | 254/88 |
| 1,650,536 | 11/1927 | Pierce | 254/88 |
| 1,752,101 | 3/1930 | Meutsch | 254/93 HP |
| 1,871,129 | 8/1932 | Pierce | 254/88 |
| 2,644,449 | 7/1953 | Champagne | 254/93 MP |

*Primary Examiner*—Al Lawrence Smith
*Assistant Examiner*—Robert C. Watson

[57] ABSTRACT

A pneumatically inflatable ramp having elastically resilient material forming the periphery of a wedge defining an enclosed internal air chamber with a protective upper surface to support a vehicle tire and a manually adjustable valve to adjustably regulate inflation. The device is pre-inflated to its normal ramp shape, a vehicle wheel to be leveled positioned thereon and air then removed from the ramp to bring the supported tire to the desired level position.

3 Claims, 7 Drawing Figures

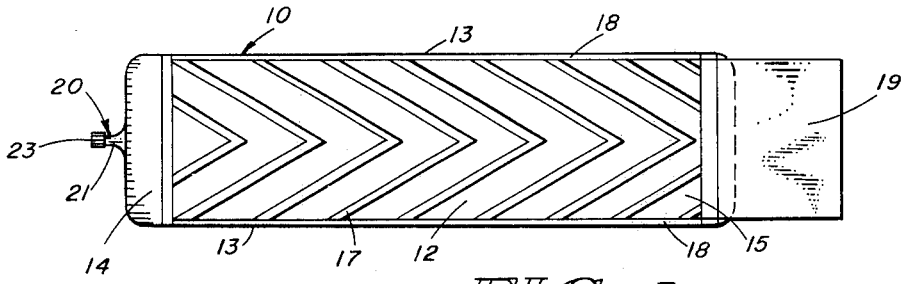
FIG. 1
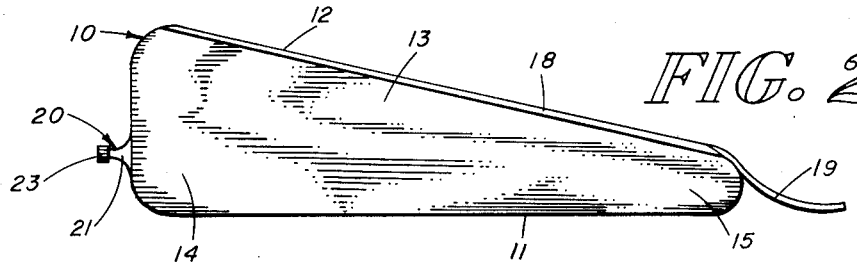
FIG. 2
FIG. 3
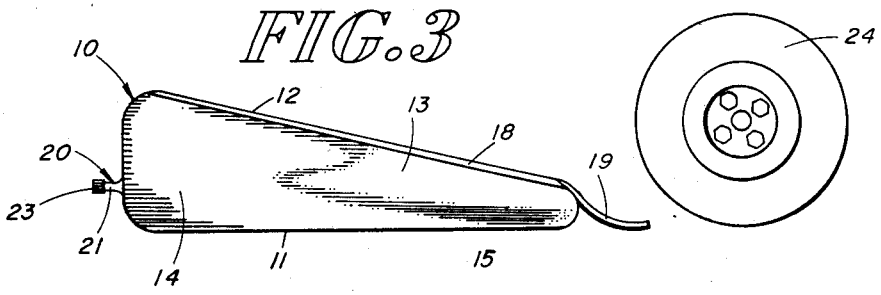
FIG. 4
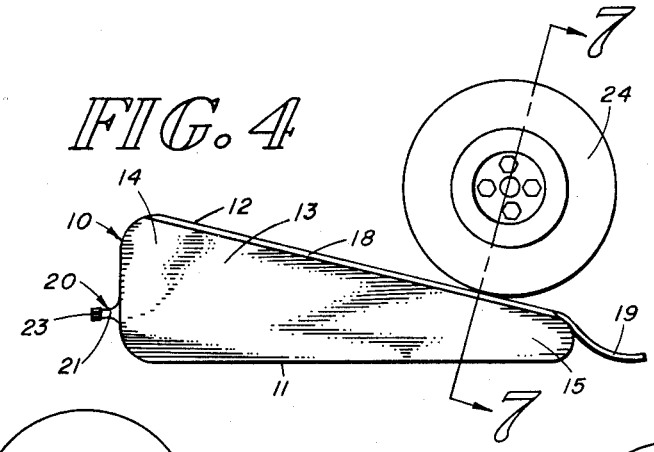
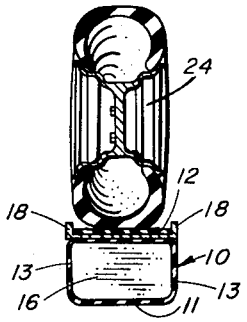
FIG. 7
FIG. 5
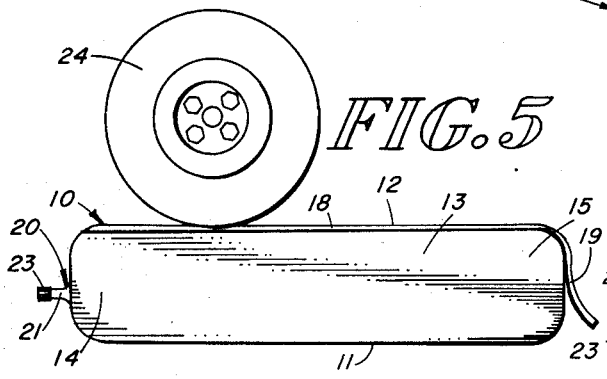
FIG. 6
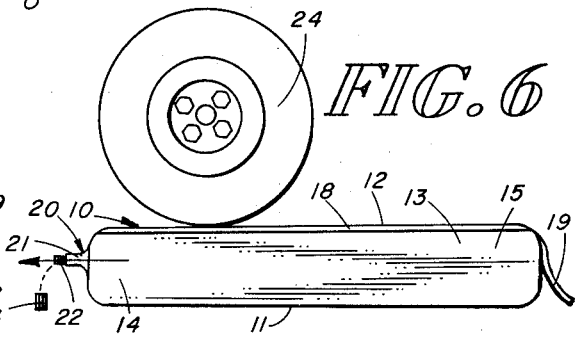

PNEUMATIC RAMP FOR VEHICLE LEVELING

RELATED APPLICATIONS

There are no related patent applications now filed in this or any foreign country.

FIELD OF INVENTION

This invention relates generally to leveling devices for self propelled vehicles and more particularly to a pre-inflated, adjustably deflatable, pneumatic ramp for leveling vehicle wheels.

DESCRIPTION OF THE PRIOR ART

It oftentimes is desirable to maintain a self propelled vehicle in a level condition during static periods, and this is particularly true in the case of motor homes, campers and other like vehicles providing living facilities in their interior. In developed areas this is usually accomplished by providing level supporting surfaces, but such environmental conditions are not normally present in undeveloped areas where such vehicles are commonly used. Responsively to this need various portable leveling devices for such vehicles have heretofore become known.

The first class of these known devices have generally provided a jack or mechanical lifting device of some sort that is usually applied to the stationary vehicle, singly or in groups, to raise the vehicles to a level condition upon appropriate manipulation. These jacks have become known in many and various types and have been operated by most of the common potentially multiplicative mechanical forces including pneumatic and hydraulic pressures. All of these devices, however, have the common feature of requiring some mechanical force to raise a stationary vehicle and by reason thereof are compound in structure, reasonably complex of operation and expensive of manufacture. This group of prior art is by this feature readily distinguishable from the instant invention.

A second class of known vehicle raising or leveling devices comprise a group of ramp structures. These structures have heretofore been known primarily for the raising of vehicles, but obviously if a vehicle be selectively raised it may thereby be leveled. Ramps in general provide a simpler, less costly structure than jacks since the vehicle itself may provide the motive power to cause it to move upon the ramp and be raised, thus alleviating any mechanical linkages in the ramp itself to cause raising. In fact, the most common of the ramp structures are merely mechanically rigid wedges upon which a vehicle may be driven and in general mechanically movable ramps do not appear to have been widely known or used in the prior art for better vehicle raising or leveling.

The instant invention is a member of the second class group of ramp type devices, but is distinguishable from the known members in that the ramp is formed of resiliently deformable material to define an internal pneumatic chamber wherein pressurized air or fluid maintains configuration. My ramp is further distinguishable in providing a manually adjustable valve for pressure relief to allow the ramp to be selectivley lowered to bring the supported wheel of a vehicle into a level position relative to the other wheels. My ramp further is distinguishable in providing a resiliently deformable structure such that as the tire of a supported vehicle move thereon the structure will deform its ramp shape to a substantially rectilinear shape with a substantially horizontal upper surface when a tire be appropriately positioned toward the higher ramp end to provide better and more stable wheel support. The resilient deformability of the ramp distinguishes it further from rigid ramps in allowing placement upon irregular surfaces with a large aerial support thereon, and in providing some shock absorbancy.

SUMMARY OF INVENTION

My invention provides a resiliently deformable material such as rubber formed to define the periphery of wedge-like ramp with an enclosed internal chamber. The upper ramp surface is provided with rigid ramp element having a tail either rigid or flexible, communicating between the ramp and the ramp supporting surface to aid entry of a vehicle tire thereon. A normally closed, adjustably openable, valve communicates through the peripheral resilient member to allow inflation and adjustable deflation. The strength of material is such that the device will support a vehicle tire and at least one-fourth of the weight of a vehicle resting thereon.

In providing such a device it is:

A principal object of my invention to provide a resiliently deformable, pneumatically inflatable, wedge-like ramp to support the tire of a self propelled vehicle.

A further object of my invention to provide a device of the nature aforesaid that may be pre-inflated and adjustably deflated to level a vehicle partially supported thereon.

A still further object of my invention to provide such a device that is elastically deformable to allow a rigid ramp to resiliently move to a substantially horizontal position when supporting a vehicle and allow the bottom portion to deform to the surface of an underlying support.

A still further object of my invention to provide such a pneumatic ramp that is of new and novel design, of rugged and durable nature, of simple and economic manufacture and otherwise well adapted to the uses and purposes for which it is intended.

Other and further objects of my invention will appear from the following specifications and accompanying drawings which form a part hereof. In carrying out the objects of my invention, however, it is to be remembered that its accidental features are susceptible of change in design and structural arrangement with only one preferred and practical embodiment being illustrated in the accompanying drawings as required.

BRIEF DESCRIPTION OF DRAWINGS k

In the accompanying drawings which form a part of this specification and wherein like numbers of reference refer to similar parts throughout:

FIG. 1 is an orthographic top view of my invention.

FIG. 2 is an orthographic side view of the invention of FIG. 1.

FIGS. 3, 4, 5 and 6 are all orthographic side views of the invention of FIG. 1, showing the entry of a vehicle on the ramp, the subsequent deformation of the ramp and leveling of the vehicle wheel.

FIG. 7 is an orthographic cross-sectional view through the ramp and supported wheel of FIG. 4, taken on the line 7—7 thereon in the direction indicated by the arrows.

DESCRIPTION OF PREFERRED EMBODIMENT

Referring now to the drawings in more detail it will be seen, particularly from FIGS. 1 and 2, that my invention comprises body element 10 configured as illustrated to form the peripheral surface of a wedge-like ramp with bottom 11, ramp 12, similar opposed sides 13, forward end 13, forward end 14 and rearward end 15. The surfaces of the body element are all structurally joined to define internal pneumatic chamber 16, which communicates through the defining peripheral body by valve structure 20. The peripheral body preferably comprises substantially planar elements communicating by rounded corners and edges to give the configuration illustrated, rather than a more bulbous rounding configuration of somewhat of an oblate spheroid, as is common with many pneumatically inflatable structures. This type of configuration may be created by appropriate structural dimensioning and re-enforcement according to precepts well known in the manufacturing arts.

Preferably body element 10 is manufactured to the configuration illustrated from some type of rubber or similar elasticized polymer. The only essential physical requirements for the materials, however, are the elastic resilience specified, the physical strength required and the pneumatic imperviousness. Other materials having these properties, such as rubberized cloth, accordian-folded sheet metals and the like, might well serve the purposes of my invention, if not so well as the elasticized materials.

Ramp or top 12 of the body is provided with traction element 17, normally formed of a rigid or semi-rigid material to provide protection for the upper surface of the ramp and distributes pressure created by support of a vehicle tire over a greater surface area than it would be distributed over without the traction element. This element is not essential to my invention but does add to its durability and ease of function. I form the element normally from sheet metal or one of the harder, more rigid, polymerizsed plastics or rubbers. The element is structurally joined to ramp 12 of the body element by mechanical adhesion such as accomplished by gluing, riveting, vulcanization and the like, depending upon the nature of the materials. This bond, however, must be reasonably strong and durable to withstand shear forces caused between the adjacent elements because of elastic deformation of the wedge when supporting a vehicle wheel. The side edges of the traction element 17 may conveniently provide upwardly extending curbs 18 to aid in maintaining a vehicle tire upon the ramp as it moves therealong. These curbs, again, are not essential to my invention by do aid its efficient operation.

Commonly, entry tab 19, formed of a tough, resiliently deformable material, is provided at the rearward end of the ramp to allow easy entry of a vehicle wheel onto the ramp, as commonly the rearward end of the ramp will have some thickness, as illustrated, rather than coming to a sharp or acute edge. This entry tab is joined by some mechanical means of fastening to the rearward end of traction element 17 and the adjacent upper surface of ramp 12 of body element 10. Normally, if the entry tab element be formed of hard rubber or plastic polymer this mechanical joinder is accomplished by a gluing type adhesion or in some instances if traction element 17 is formed of a semi-flexible material the entry tab 19 may merely be a rearward extension of that traction element and the two initially formed and manufactured as a unitary structure. Again, this entry tab is not essential to my invention but does aid the ease of its operability.

Valve structure 20 comprises an ordinary tire-type pneumatic vlave, as illustrated, providing stem 21 communicating to threaded external orifice 22 which threadedly carries protective cap 23. The valve structure provides a valve that allows inflow or pressurizsed air and normally prevents outflow of air but is manually manipuable to allow pre-determined air outflow. This particular type of valve is well known in the arts relating to pneumatic tires for vehicles and its detailed structure is therefore not described as that detailed structure forms no essential part of my invention, Other valves that provide for imput of pressurized air and prevent outflow of that air until released by manual manipulation would serve the purposes of my invention. Valve structure 20 is mechanically joined to body element 10, normally in forward end 14, as illustrated, by appropriate mechanical means. In the instance illustrated the valve body is formed of a rubber-like polymer as is the body element and the two are joined by normal vulcanization processes.

Having thusly described the structure of my invention, its operation may now be understood with particular reference to FIGS. 3, 4, 5 and 6.

Firstly, my invention is formed according to the foregoing specification, normally with a forward end height of some several inches and a side length appropriate to create a slope of ramp 12 of about 15°–20° of angle though neither the dimensioning nor the slope are critical or essential to my invention. The device is inflated to full extension and with sufficient pressure to support the weight it is ultimately to carry. The ramp is then placed immediately forwardly of wheel 24 of a vehicle (not shown) to be leveled with the bottom 11 of my device resting on a supporting surface, normally the earth (not shown) supporting the vehicle in question, and the lower end of ramp 12 facting wheel 24, all as illustrated in FIG. 3.

In this position then, the vehicle supported by wheel 24 is moved forwardly by its own power so that the wheel enters upon the ramp 12 of body 10, as illustrated in FIG. 4. The vehicle motion is continued in a forward direction until the point of contact of wheel 24 and ramp 12 is forwardly of the forward- rearward medial point of traction element 17, at which point the forward portion of the traction element and top 12 of the body element 10 will tend to move downwardly and the rearward portion will tend to move upwardly, with appropriate elastic deformation to compensate for the then existing forces, so that the structure assumes a somewhat recilinear configuration substantially as illustrated in FIG. 5.

With the vehicle on the pneumatic ramp then, valve structure 20 is manually manipulated to allow air to flow outwardly therethrough and from pneumatic chamber 16 to the ambient atmosphere, thus lowering ramp 12 of the body with reference to its bottom and the surface supporting it and thusly lowering the supported vehicle to the desired level position.

Normally with a four-wheeled vehicle this leveling may be accomplished with appropriate vehicle positioning by usng a ramp under one wheel, but obviously a plurality of ramps may be used to accomplish the result and ramps might even be placed under each wheel of a vehicle if desired.

Obviously, a particular ramp may be formed to almost any configuration, but for ease and convenience of use I prefer that the slope be not more than approximately 20 degrees as it may be difficult to move the vehicle forwardly on the ramp, if the slope be greater. The ramp, again, may be of any esred height, but normally the forward end 14 will not be more than 6 or 8 inches because of the strength and nature of materials involved in forming the device and the general lack of need for any greater height.

It is to be particularly noted that my pneumatic ramp will normally be pre-inflated at sometime before use from some source of pressurized air as commonly available at automotive service stations. It is to be remembered, however, that if it be required to inflate the device manually, it is under no pressure when it is initially inflated and this therefore makes inflation most simple and easy since inflation is not being accomplished under an resisting pressure as in the case of a jack bearing a load.

It is further to be noted that since bottom 11 of my invention is formed of elastically resilient material it will conformable adapt itself to an irregular surface upon which it rests, thus sreading its support pressure over a much wider area than would be done if the element were rigid. It should also be noted that since the entire body element is elastically resilient the entire device tends to serve as a shock absorber and stabilizer for a vehicle wheel supported upon it. Both of these effects tend to combine to provide an extremely stale leveling platform for a vehicle.

Having thusly described my invention, what I desire to protect by Letters Patent, and

What I claim is:

1. An inflatable ramp for the support of vehicle wheels positioned thereon, comprising, in combination:

a wedge shaped body formed of resilient peripheral elements defining an enclosed, medial chamber for containment of pressurized fluid and having a traction element more rigid than the body carried on the sloping ramp of the body by mechanical joinder of the adjacent surfaces; and a valve structure communicating externally through the body from the pressurized fluid chamber, normally closed but mechanically openable to allow input of pressurized fluid to the chamber and predetermined outflow therethrough responsive to appropriate manipulation.

2. The invention of claim 1 further characterized by: a semi-rigid entry tab extending from the rearwardmost portion of the traction element to the surface supporting the body to aid in entry of a vehicle wheel thereover and upon the ramp.

3. A pre-inflatable pneumatic ramp for adjustably leveling a wheel of a self propelled vehicle, comprising, in combination:

a wedge shaped body defined by an elestically resilient peripheral element enclosing an internal pneumatic chamber with a traction element more rigid than the body carried on the ramp of the body by adhesion thereto;

a valve structure, having an external orifice, communicating through the elastically resilient peripheral member and into the pneumatic chamber defined thereby, sad valve structure being normally closed but having means to allow the input of pressurized gas into the pneumatic chamber and manually manipuable, means to allow a pre-determined outflow of pressurized gas from the pneumatic chamber; and a semi-rigid entry tab, mechanically fastened to the rearward portion of the traction element and adjacent ramp of the body, and extending rearwardly therefrom to communication with a surface supporting the entire structure to aid entry of a vehicle wheel upon the ramp.

* * * * *